US009511883B2

(12) United States Patent
Otxoa-Aizpurua Calvo et al.

(10) Patent No.: US 9,511,883 B2
(45) Date of Patent: Dec. 6, 2016

(54) METHOD FOR OPERATING A VERTICAL PACKAGING MACHINE AND VERTICAL PACKAGING MACHINE

(71) Applicant: ULMA Packaging Technological Center, S.COOP., Oñati (ES)

(72) Inventors: Alberto Otxoa-Aizpurua Calvo, Oñati (ES); Mikel Orobengoa Crucelaegui, Oñati (ES)

(73) Assignee: ULMA Packaging Technological Center S. Coop, Onati (ES)

( * ) Notice: Subject to any disclaimer, the term of this patent is extended or adjusted under 35 U.S.C. 154(b) by 757 days.

(21) Appl. No.: 13/892,892

(22) Filed: May 13, 2013

(65) Prior Publication Data

US 2013/0298505 A1 Nov. 14, 2013

(30) Foreign Application Priority Data

May 14, 2012 (EP) ..... 12382175

(51) Int. Cl.

| | |
|---|---|
| ***B65B 1/02*** | (2006.01) |
| ***B65B 41/16*** | (2006.01) |
| ***B65B 51/30*** | (2006.01) |
| ***B65B 57/04*** | (2006.01) |
| ***B65B 9/20*** | (2012.01) |
| ***B65B 9/213*** | (2012.01) |
| *B65B 9/207* | (2012.01) |

(52) U.S. Cl.

CPC ..... *B65B 1/02* (2013.01); *B65B 9/2028* (2013.01); *B65B 9/213* (2013.01); *B65B 41/16* (2013.01); *B65B 51/303* (2013.01); *B65B 57/04* (2013.01); *B65B 9/207* (2013.01)

(58) Field of Classification Search

CPC ..... B65B 1/02; B65B 1/00; B65B 9/20; B65B 9/08

USPC ..... 53/550, 451, 551, 52, 51, 133.4, 139.2; 493/186

See application file for complete search history.

(56) References Cited

U.S. PATENT DOCUMENTS

| | | | |
|---|---|---|---|
| 4,757,668 | A | 7/1988 | Klinkel et al. |
| 4,800,707 | A | 1/1989 | Rabus |

(Continued)

FOREIGN PATENT DOCUMENTS

| | | | |
|---|---|---|---|
| DE | 102004031780 | A1 | 1/2006 |
| EP | 0229216 | A2 | 7/1987 |

(Continued)

OTHER PUBLICATIONS

Extended European Search Report (ISR) for European Patent Application No. 12382175.3, Date of Mailing Nov. 14, 2012, 6 pages, European Patent Office, Munich Germany.

*Primary Examiner* — Hemant M Desai
*Assistant Examiner* — Mary Hibbert
(74) *Attorney, Agent, or Firm* — Edell, Shapiro & Finnan LLC

(57) ABSTRACT

According to some implementations a packaging operation is provided that includes a stage for the continuous feeding of a laminar film, a stage for the forming of the laminar film with a laminar tube being obtained, and a drive stage in which by means of at least two drive belts the movement of the laminar tube is caused. The packaging operation also includes a control operation in which the position of the drive belt in relation to the forming tool is controlled when slippage or risk of slippage of at least one of the drive belts with respect to the laminar tube is detected.

7 Claims, 4 Drawing Sheets

(56) References Cited

U.S. PATENT DOCUMENTS

| | | | | | |
|---|---|---|---|---|---|
| 4,884,387 | A * | 12/1989 | James | B65B 9/2028 | 53/389.5 |
| 5,125,217 | A * | 6/1992 | Fukuda | B65B 9/20 | 198/689.1 |
| 6,131,373 | A | 10/2000 | Cherney | | |
| 6,200,249 | B1 * | 3/2001 | Fukuda | B65B 9/20 | 493/186 |
| 6,378,277 | B1 | 4/2002 | Inoue et al. | | |
| 2011/0023423 | A1 * | 2/2011 | Iwasaki | B65B 1/32 | 53/510 |

FOREIGN PATENT DOCUMENTS

| | | | |
|---|---|---|---|
| EP | 832818 | A1 | 4/1998 |
| EP | 2287078 | A1 | 2/2011 |
| GB | 2096091 | A | 10/1982 |

* cited by examiner

METHOD FOR OPERATING A VERTICAL PACKAGING MACHINE AND VERTICAL PACKAGING MACHINE

CROSS-REFERENCE TO RELATED APPLICATIONS

This application relates to and claims the benefit and priority to European Patent Application No. 12382175, filed May 14, 2012.

TECHNICAL FIELD

The invention relates to a method for operating a packaging machine, in particular of a vertical packaging machine, and the vertical packaging machine.

BACKGROUND

There are known vertical packaging machines that comprise a feeder that supplies a laminar film, a forming tool adapted to give a tubular shape to the laminar film, forming a laminar tube, and at least two advance modules, each one of which comprises at least one drive belt arranged facing the forming tool. The drive belts, as they move, cause the movement of the laminar tube towards one end of the exit of the forming tool. In addition, these machines comprise longitudinal sealing means adapted to seal longitudinally the two longitudinal ends of the laminar film that forms the laminar tube, and transverse cutting and sealing means to generate packaging from the laminar tube, once the products to be packaged have been inserted into the interior of the forming tool. Vertical packaging machines of these characteristics are described in GB2096091A, US4800707 and EP0832818A1.

GB2096091 also discloses a specific type of vertical packaging machine, of the type that causes the movement of the laminar tube by vacuum in relation to the advance means. In the vertical vacuum packaging machine the suction of the laminar tube is caused by the drive belts, towards them, generating a connection by means of friction between the belts and the laminar tube. Said connection by friction forces the laminar tube to move in conjunction with the movement of the drive belts.

Different sizes of packages may be obtained by exchanging the forming tool. For the purpose of detecting that the operator positions the forming tool with the correct dimensions in order to obtain the required packaging, EP832818A1 describes a vertical packaging machine that comprises conveyor belt-type movement means that move the advance means from reference positions towards the laminar tube, and means for measuring the distance travelled by the movement means, which allow the dimensions of the forming tool to be identified and ensure that the operator has placed the tool corresponding to the package to be obtained.

Finally, U.S. Pat. No. 4,800,707 describes a vertical packaging machine that comprises servomotors that move the advance means in a horizontal direction, moving them towards or away from the forming tool to adjust the vertical packaging machine according to the size of the forming tool during the setting up of the machine.

SUMMARY OF THE DISCLOSURE

According to some implementations a method is provided that includes a packaging operation that at least comprises a feeding stage in which is supplied a laminar film in a continuous or intermittent manner, a forming stage in which the laminar film is formed to give it a tubular shape by means of a forming tool, obtaining a laminar tube, and a drive stage in which by means of at least two drive belts arranged facing each other, each drive belt belonging to a respective advance module causes the movement of the laminar tube.

According to some implementations the method for operating also comprises a control operation in which the position of the drive belt of each advance module in relation to the forming tool during the packaging operation is controlled, acting in an automatic manner on at least one displacement module that operates the corresponding advance module, when it is detected that a slippage or a risk of slippage of at least one of the drive belts in relation to the laminar tube. When slippage occurs, the movement of the laminar tube for generating a package is not correct, which may lead to packages of different sizes being generated, said packages being considered defective.

In addition, the machine comprises a feeder that supplies a laminar film, a forming tool adapted to give a tubular shape to the laminar film, at least two advance modules each one of which comprises a drive belt facing said forming tool, which as it moves causes the movement of the laminar tube towards one outlet end of the forming tool, and a displacement module attached to the advance module. Furthermore, the machine comprises means for detecting slippage or risk of slippage of at least one of the drive belts in relation to the laminar tube, and control means that are arranged communicated with the detection means and which control the position of the belt in relation to the forming tool during the packaging operation, the control means acting on the respective advance module through the displacement module according to the values measured by the detection means.

As a result, thanks to the use of the controlled displacement modules, the drive the advance modules generate on the laminar film may be improved, as the distance between the forming tool and the drive belt comprised in each advance module may be regulated automatically, in order to ensure that each drive belt comes into contact with the laminar film and thereby ensure their advance, avoiding slippage or preventing it beforehand. Additionally, the displacement modules allow the movement of the drive belts at any time during the packaging process to adapt the distance between each drive belt and the forming tool along the way, ensuring that the laminar tube is driven during the packaging process, thereby preventing slippage or the risk of slippage between the laminar tube and at least one of the drive belts. As a result, the manual adjusting that must be carried out in the machines of the prior art is avoided, wherein prior to starting the machine the operator must adjust the position of each advance module in relation to the laminar tube. As a result, start-up times and format-change times are reduced, and possible human errors in said operations are also prevented. In addition, with this method the wear of the belts is reduced, as it is not necessary for the belts to maintain unnecessary pressure on the laminar tube for the purpose of preventing slippage, and the adjusting of the drive belts in relation to the tube formed during the packaging operation is optimised, which results in a drastic reduction in the number of defective packages.

These and other advantages and characteristics of the invention will be made evident in the light of the drawings and the detailed description thereof.

DETAILED DESCRIPTION

Figure 1:
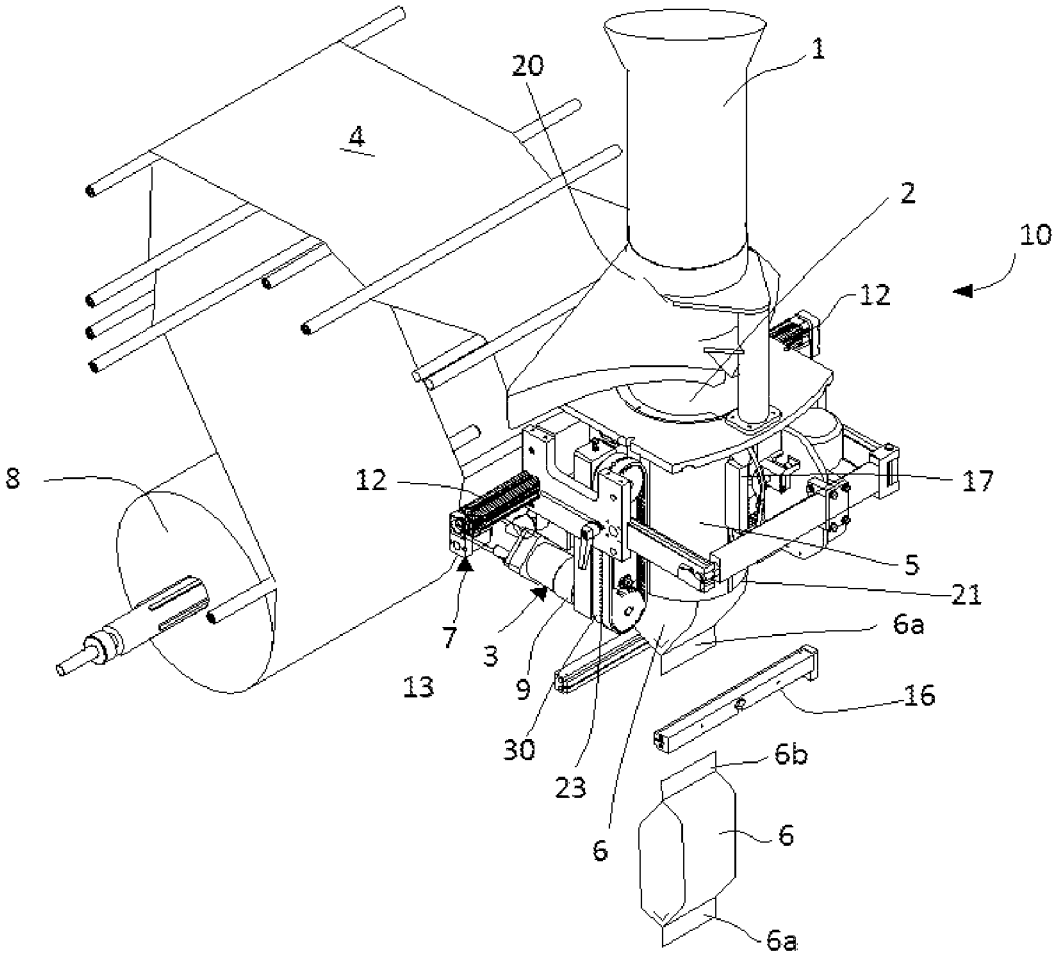
FIG. 1 shows a view in perspective of a vertical packaging machine according to one implementation.
Figure 2:
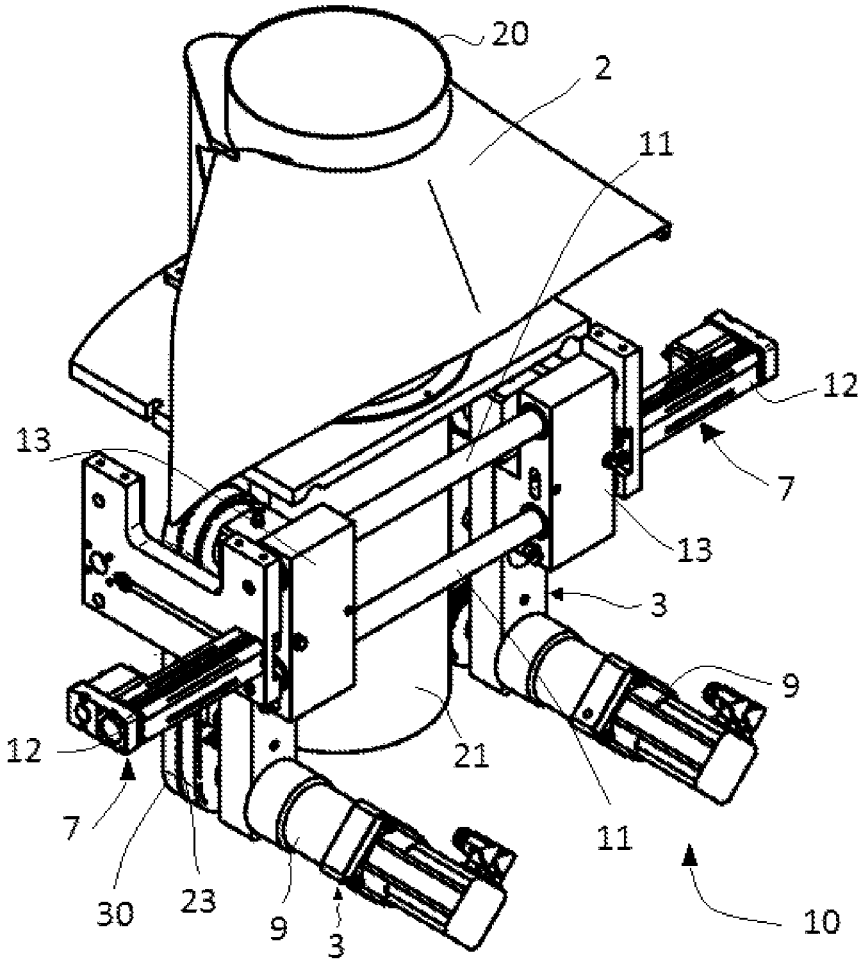
FIG. 2 is a partial view in perspective of the vertical packaging machine shown in FIG. 1, in which a forming tool, movement means and advance means are shown.
Figure 3:
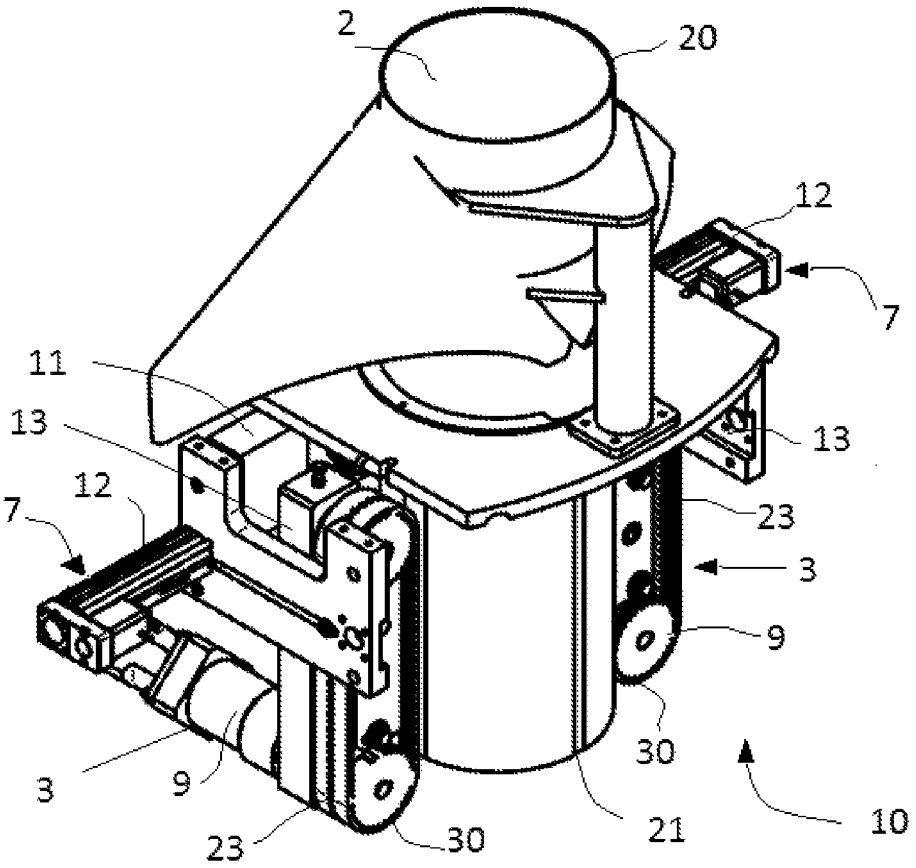
FIG. 3 is another partial view in perspective of the vertical packaging machine shown in FIG. 1, in which a forming tool, movement means and advance means are shown.
Figure 4:
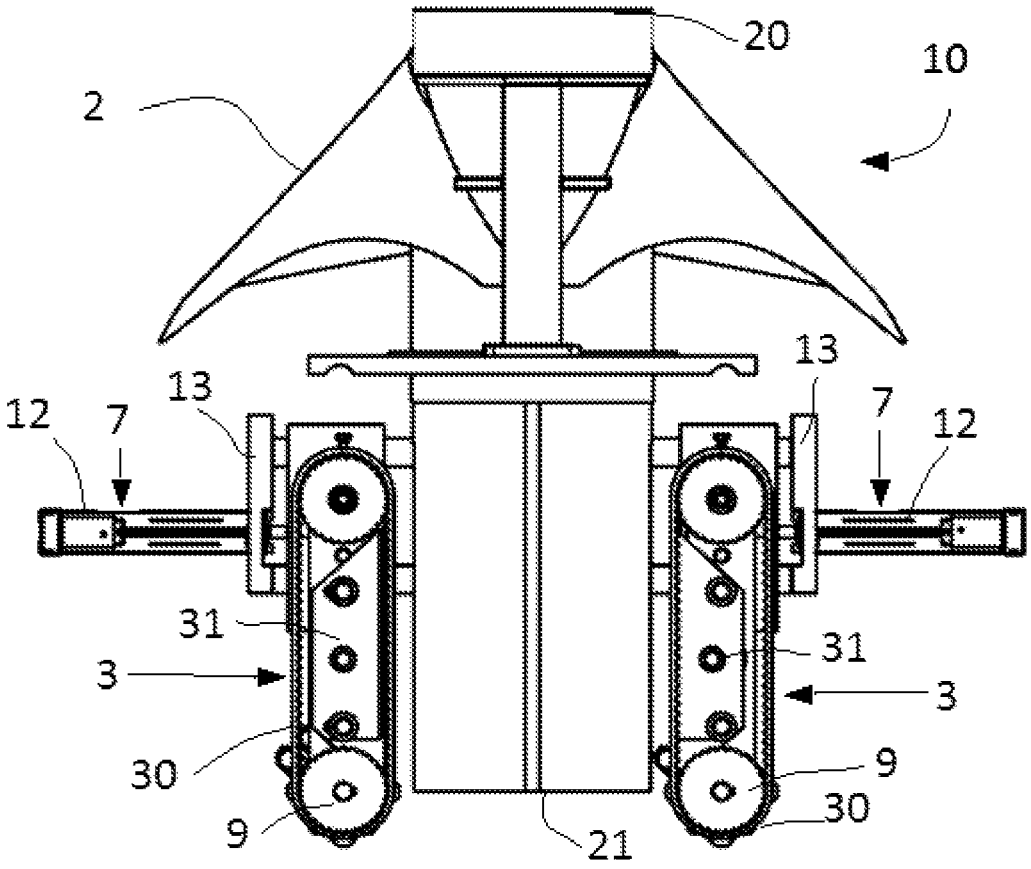
FIG. 4 is a front view of the vertical packaging machine shown in FIG. 1, in which a forming tool, movement means and advance means are shown.

One aspect of the invention relates to a vertical packaging machine 10, such as the one shown by way of example in FIG. 1. According to some implementations the machine 10 comprises at least the following elements: a feeder 1, a forming tool 2, longitudinal sealing means 16, transverse cutting and sealing means 17, and at least two advance modules 3 that are arranged diametrically opposite in relation to the forming tool 2, facing said forming tool 2.

The feeder 1 is adapted to supply a laminar film 4 to the forming tool 2, as shown in FIG. 1. The laminar film 4 is generally stored in the form of a reel. Additionally, the feeder 1 may comprise a shaft of rotation on which the reel 8 is arranged and which rotates to supply the laminar film 4.

The forming tool 2 is adapted to give a tubular shape to the laminar film 4 that the feeder 1 supplies. The forming tool 2 corresponds with a tube, with an upper inlet end 20 adapted to receive the laminar film 4 that the feeder 1 supplies and a lower outlet end 21 through which said laminar film 4 is removed, as commented below. The inlet end 20 comprises a shape that causes the laminar film 4 to surround the forming tool 2 and a longitudinal end of the laminar film 4 to overlap with the opposite longitudinal end of the laminar film 4, said laminar film 4 thereby acquiring a tubular shape. In other embodiments not shown in the figures, the forming tool 2 may be arranged to form an angle in relation to a vertical axis. In addition, the forming tool 2 is also adapted to insert in the interior of the hollow formed tube the products to be packaged. The geometry of the forming tool 2 is known in the prior art of vertical packaging machines, as a result of which it is not deemed necessary for a detailed description to be included here.

The longitudinal sealing means 16 is adapted to seal longitudinally the two longitudinal ends of the laminar film 4 with a tubular shape, a laminar tube 5 being generated from the laminar film 4.

The transverse cutting and sealing means 17 is adapted to seal the laminar tube 5 transversally and to cut the laminar tube 5 transversally, there being obtained with each cut a package 6 with its ends sealed, where the product to be packaged is packaged.

The products to be packaged are supplied through the space of the forming tool 2. Prior to the supply of products, the laminar tube 5 is formed and the transverse cutting and sealing means 16 seal the lower end of the laminar tube 5, forming the base 6*a* of the package 6, as shown in FIG. 1. Subsequently, and once the products to be packaged have been deposited in the package 6, the three following operations are carried out, usually simultaneously: the upper end 6*b* of the package 6 is sealed, generated in such a way that the package 6 is sealed completely; the laminar tube 5 forming the base 6*a* of the following package 6 is sealed; and finally a transverse cut of the laminar tube 5 is made between the seal of the upper end 6*b* of the package 6 and the seal of the base 6*a* of the following package 6. As a result, when the products are supplied through the space of the forming tool 2, said laminar tube 5 is sealed in its lower part 6*a*, the products being housed in its interior. Subsequently, when the laminar tube 5 is cut transversally and the package 6 generated, said package 6 is sealed completely with the required product or products in its interior.

In addition, each advance module 3 comprises at least one worm drive belt 30 arranged in a vertical position, facing the forming tube 2, and at least one motor 9 to cause the movement of the drive belt 30. In the machine 10 shown in FIGS. 1 to 4, the motor 9 is a servomotor, although in other embodiments another type of motor or actuator may be used.

The advance module 3 causes the movement by driving of the laminar tube 5 towards the outlet end 21 of the forming tube 2. To achieve this, the drive belt 30 is arranged in contact with the laminar tube 5 and as it moves it drives the laminar tube 5. The use of at least two advance modules 3, arranged diametrically opposite to each other in relation to the forming tool 2, instead of one only, improves the driving of the laminar tube 5 as it allows more homogeneous driving.

To ensure that the driving of the laminar tube 5 by the advance modules 3 is correct and that there is no slippage of at least one of the belts 30 in relation to the laminar tube 5, it must be ensure that the position of the advance modules 3, and therefore the drive belts 30, is correct both before starting the packaging operation, in other words in the set-up or start-up of the machine 10, and during the packaging operation.

To ensure the correct driving of the laminar tube 5 by the advance modules 3 or to reduce the risk of slippage, the machine 10 also comprises a displacement module 7 connected to each advance module 3, which is adapted to move the corresponding advance module 3, closer to or away from the forming tool 2. Each displacement module 7 comprises at least one guide 11 on which the respective advance module 3 moves, an actuator 12 that operates the movement of the respective advance module 3 along the guide 11, and a support 13 that supports the actuator 12 and the corresponding advance module 3. In the embodiment of the machine 10 shown in FIGS. 1 to 4, the machine 10 comprises two displacement modules 7, each one connected to the corresponding advance module 3 and both displacement modules 7 sharing the guides 11. In addition, the actuator 12 may be a linear actuator or any other type of motor capable of moving the corresponding support 13 and, therefore, the advance module 3.

The movement of the advance modules 3 and, therefore, of the drive belts 30 in relation to the forming tool 2 is caused by actuators 12, and the movement of the drive belts 30 to drive the laminar tube 5 is caused by drive mechanisms 9 other than the aforementioned actuators 12. As a result, the motors 9 of the two advance modules 3 operate in a synchronised manner to cause the same movement of the laminar tube 5 by each drive belt 30, whereas the displacement module 7 moves, preferably horizontally, each advance module 3 in relation to the forming tool 2.

Additionally, the machine 10 also comprises, control means, not shown in the figures, to control in an automatic manner both displacement modules 7 during the start-up of the machine 10 and the entire packaging process, with the result that said displacement modules 7 may be moved in relation to the forming tool 2 in a synchronised or independent manner. The control means may comprise a microprocessor, microcontroller, equivalent devices or additional devices known in the prior art and capable of performing the aforementioned functions.

As a result, thanks to the use of controlled displacement modules 7 the driving that the drive belts 30 generate on the laminar tube 5 is improved in a simple, rapid and dynamic manner, as the approach of each drive belt 30 towards the laminar tube 5 when it detects slippage or the risk of slippage may be regulated in an automatic manner. In addition, the displacement modules 7 allow the movement of the drive belts 30 at any time, this being capable of occurring, for example, during the installation of the machine, a more rapid, safer and comfortable installation thus being obtained as the user is not involved; during the installation or replacement of a forming tool 2 with a different diameter to the previous one to be adapted to the new diameter in a more rapid, safer and comfortable manner, these first actions on the machine being known as set-up or start-up operations; and during the packaging operation itself to adapt the distance between each drive belt 30 and the forming tool 2, automatically ensuring the driving of the laminar film during the packaging process, thus preventing slippage between the laminar tube 5 and the drive belts 30. The adjusting of each drive belt 30 in relation to the forming tool 2 may be carried out independently.

The vertical packaging machine 10 also comprises detection means that allows the slippage or risk of slippage of at least one of the drive belts 30 in relation to the laminar tube 5 to be detected. For its part, the control means is arranged connected to the detection means, with the result that according to the values measured by the detection means, the control means controls the position of each belt 30 in relation to the forming tool 2, both in the set-up operation and in the packaging operation, acting on the respective advance module 3 through the displacement module 7.

The detection means detects the movement of the laminar tube 5, and/or the vacuum between the respective drive belt 30 and the laminar tube 5, and/or the force that the displacement module 7 exerts against the laminar tube 5 through the respective advance module 3, and/or the distance of the laminar tube 5 to the forming tool 2. To achieve this, the detection means comprises at least one movement sensor that detects the movement of the laminar tube 5, and/or a vacuum sensor that detects the vacuum between the respective drive belt 30 and the laminar tube 5, and/or a force meter that sets the force that the displacement module 7 exerts against the forming tool 2 through the respective advance module 3, and/or a position sensor that detects the distance between the advance module 3 or the drive belts 30 and the forming tool 2.

The control means may act independently on each displacement module 7.

FIGS. 1 to 4 show a vertical vacuum packaging machine 10. In vertical vacuum packaging machines 10 the movement of the laminar tube 5 is performed by suction against the belts 30. To achieve this, vertical vacuum packaging machines 10 comprise vacuum means that comprise holes 23 along each belt 30, at least one vacuum device 31 housed in each belt 30, a vacuum sensor (not shown in the figures) that measures the vacuum level in the vacuum device 31 and, therefore, between the belt 30 and the laminar tube 5, and a vacuum pump, not shown in the figures, connected to the vacuum device 31 by a conduit not shown in the figures, with the result that the pump creates the vacuum in the vacuum device 31 and, therefore, sucks the laminar tube 5 against the belt 30 through the holes 23.

In other embodiments, not shown in the figures, vertical packaging machines may use friction, in other words the movement of the laminar tube 5 is achieved by friction against the corresponding belt 30. The features of the advance modules 3 of vertical friction-type or vacuum-type packaging machines are known in the prior art and do not, therefore, need to be described in detail. In addition, the features of the vertical packaging machine 10 detailed to this point are common to both types of machines.

Another aspect of the invention relates to the method of operation of the vertical packaging machine 10. The packaging machine corresponds with a machine such as the one referred to in the first aspect of the invention, in which the following method may be implemented in any of its configurations and embodiments.

The method of operation of a vertical packaging machine, either the friction or vacuum type, comprises, as commented above, a start-up operation and another packaging operation.

During the start-up operation, the detection means measures the force that the displacement module 7 is exerting through the respective advance module 3 on the forming tool 2. The control means then compares said measured force with a predetermined force value that indicates the optimum force with which each belt 30 must press against the forming tool 2. The control means determines that there is a risk of slippage when the value of the measured force is smaller than the value of the predetermined force, the determined force being that which causes the belts 30 to exert sufficient pressure against the forming tool 2 to prevent slippage, and not an excessive amount, to prevent the unnecessary wear of the belts 30.

While the belt 30 is not in contact with the forming tool 2, the force will be minimal, whereas it increases when it is in contact with the forming tool 2.

When the measured force is smaller than the predetermined force, the control means operates the corresponding displacement module 7, which in turn moves the advance module and, therefore, the belt 30 towards the forming tool 2 until the measured force is substantially equal to the predetermined force. When each of the advance modules 3 comes into contact with the forming tool 2 and the control means detects that the force that the corresponding displacement module 7 exerts on the forming tool 2 is substantially equal to the predetermined force, they keep the corresponding advance module 3 in said position, said position being known as the zero position. The detection of the force may be detected by measuring the power consumed by the displacement module 7, or by other methods. This stage in the set-up operation may be common to both vertical friction-type and vacuum-type packaging machines.

In vertical vacuum packaging machines 10, during the set-up operation, when the force exerted by the displacement module 7 reaches the value of the determined force, the control means operates the displacement module 7, which moves the advance module in an opposite direction, it being moved away by a predetermined distance in relation to the zero position. This is necessary to prevent the laminar tube 5 sticking against the forming tool 2, which is generally made of metal, when frozen foods are inserted, for example, or to prevent the belts from wearing when elements, such as resealable devices, easy-to-open devices, aroma valves, etc. not shown in the figures, are arranged on the laminar film 4. The predetermined distance that each advance module 3 withdraws may be a fixed predetermined value or a variable predetermined value, depending on the diameter of the forming tube 2.

When the set-up or start-up operation is completed, the advance modules 3 are positioned in relation to the forming tool 2, with the result that the belts 30 exert sufficient pressure against the forming tool 2 but not an excessive amount to prevent the unnecessary wear of the belts in the case of vertical friction-type machines, or the advance modules 3 are positioned at a predetermined distance in relation to the forming tool 2, with the result that the belts 30 exert a sufficient vacuum to drive the laminar tube 5 without slippage in the case of vertical vacuum machines.

In the packaging operation, the feeder 1 supplies the laminar film 4, said laminar film 4 is formed by means of the forming tool 2 in the forming stage, to give it the tubular shape, the laminar tube 5 being obtained. The laminar tube 5 is moved by means of the drive belts 30 arranged facing each other. As the laminar tube 5 is moved, the longitudinal ends of the laminar film 4 that form said laminar tube 5 are sealed longitudinally. Finally, the packaging operation comprises a phase for the insertion of products through the interior of the forming tool 2 and a cutting and sealing phase in which the package 6 with the required product housed in its interior is obtained, as described above and shown in FIG. 1.

The packaging operation comprises a control operation in which the position of the drive belt 30 of each advance module 3 in relation to the forming tool 2 is controlled, acting on the displacement module 7 that operates the corresponding advance module 3 when slippage or a risk of slippage of at least one of the drive belts in relation to the laminar tube 5 is detected.

In a first embodiment, when the control means detects slippage it operates the corresponding displacement module 7 so that the advance module 3 moves towards the forming tool 2. To determine the slippage between a drive belt 30 and the laminar tube 5 the advance of the laminar tube 5 is measured and the advance of the drive belt 30 is measured and the two values are compared. It is determined that there is slippage if they are different values or if the difference between the two values measured is greater than a predetermined relative advance value.

In such an embodiment the detection means may comprise probes, optical sensors or other detection members capable of detecting the movement of the laminar tube 5 or the movement of the laminar film 4. In the event that the optical sensor is used, the laminar tube 5 or the laminar film 4 may comprise a plurality of marks distributed uniformly and longitudinally, which are detected by the optical sensor.

This control stage may be implemented during the packaging operation, both in vertical friction-type and vacuum-type packaging machines.

In a second embodiment the control means detects the risk of slippage by measuring the distance of the respective advance module 3 or the respective drive belt 30 in relation to the zero position of the forming tool 2, and comparing said distance with a predetermined distance. The predetermined distance is optimised to drive and move without slippage the laminar tube 5, without there being excessive pressure that leads to higher consumption of energy in the case of vertical friction-type machines, a risk of the laminar tube 5 sticking to the forming tool in vacuum-type machines, or excessive wear of the belt 30 both in friction-type machines and in vacuum-type machines with elements added to the laminar tube 5 or the laminar film 4.

In this second embodiment, it is determined that there is a risk of slippage if the distance measured does not coincide substantially with the predetermined distance. In this case, the control means operate the displacement module 7 of the corresponding belt 30, the respective advance module 3 moving in relation to the forming tool 2 until the distance measured reaches substantially the value of the predetermined distance. In the case of drive-type machines, it is determined that there is a risk of slippage if the distance measured is greater than the predetermined distance corresponding to the zero position, the corresponding advance module 3 moving towards the forming tool 2. In the event that the distance measured is smaller than the predetermined distance, the control means acts on the corresponding displacement module so that the advance module 3 moves away in relation to the forming tool 2 to the predetermined distance to prevent excessive wear of the belts 30. Furthermore, in the case of vacuum-type machines, it is determined that there is a risk of slippage both if the distance measured is greater than the predetermined distance and if it is smaller, as in this case there is a risk of the laminar tube 5 sticking to the forming tool 2 and, therefore, of slippage. In this last case, the control means operates the displacement module 7 of the corresponding belt 30, moving the respective advance module 3, it moving away from the forming tool 2 until the distance measured reaches substantially the value of the predetermined distance. The fact that linear motors or linear actuators are used as displacement modules 7 allows both advance modules 3 to move towards or away in a controlled manner in relation to the forming tool 2, the slippage being capable of being predicted and above all eliminated, if there is any, in an automatic manner.

In a third embodiment it is possible to combine the detection means described in the first and second embodiment, with the result that the control means establishes the comparison between the measured movement of the laminar tube 5 and the movement of the belt 30 as well as the distance measured between the corresponding advance module 3 and the forming tool 2 and the predetermined distance, the control means acting on each displacement module 7 according to the value considered the most restrictive. This third embodiment may be implemented in vertical friction-type or vacuum-type packaging machines.

In a fourth embodiment the packaging operation comprises a vacuum operation during which the vacuum is induced by means of the vacuum pump on the laminar tube 5 so that each belt 30 holds and drives the laminar tube 5. In the control operation, the risk of slippage of the corresponding belt 30 and the laminar tube 5 is detected automatically, the vacuum level being measured and it being determined that there is a risk of slippage if the vacuum level measured is smaller than a predetermined threshold vacuum level, the predetermined threshold vacuum level being that which optimally allows the movement of the laminar tube 5 in relation to each belt 30 without there being an excess of power consumption.

The detection means may comprise a vacuum switch (not shown in the figures), which is adapted to determine the vacuum level provided by the vacuum pump, the vacuum switch being connected to the control means. These types of elements are conventional, and what they actually do is determine the amount of air sucked by the vacuum pump: the more air is sucked, the lower the vacuum level. The control means, according to the information received by the vacuum switches, determines if there is a risk of slippage or not between the laminar tube 5 and the corresponding drive belt 30 and causes the corresponding advance module 3 to move closer to the forming tool 2.

In other embodiments it is possible to combine the detection means described in the first and the fourth embodiment, with the result that the control means establishes the comparison between the measured movement of the laminar tube 5 and the movement of the belt 30, as well as the comparison between the vacuum level measured and the predetermined threshold vacuum value, the control means acting on each displacement module 7 according to the value considered the most restrictive of both comparisons.

In other embodiments it is possible to combine the detection means described in the second and the fourth embodiment, with the result that the control means establishes the comparison between the distance of the corresponding advance module 3 and the forming tool 2 and the predetermined distance, as well as the comparison between the vacuum level measured and the predetermined threshold vacuum value, the control means acting on each displacement module 7 according to the value considered most restrictive of both comparisons.

In another embodiment, the packaging operation comprises a vacuum operation similar to the one described in the fourth embodiment. In addition, during the control operation slippage is detected automatically, the actual advance of the laminar tube 5 and the advance of the belt 30 being measured, and it being determined that there is slippage if the two values are different or if the difference between the two values is greater than the predetermined relative advance value, as described in the first embodiment, or a risk of slippage is detected, the vacuum level being measured and it being determined that there is a risk of slippage if the vacuum level measured is smaller than the predetermined threshold vacuum level, as described in the fourth embodiment. In addition, the distance between each advance module 3 and the forming tool 2 is measured, said distance being compared with the predetermined distance, as described in the second embodiment. In the event that the distance measured is at least substantially equal to the predetermined distance, the control means increases the power in the vacuum pump to a predetermined maximum power value of the vacuum pump if this threshold vacuum level is not reached.

Once a movement without slippage of the laminar tube 5 in relation to the forming tool 2 is ensured after increasing the power of the vacuum pump, the respective advance module 3 is moved away in relation to the forming tool 2 to a critical distance, critical distance being understood as the maximum distance in each case that the advance means 3 may travel from the zero position in order to prevent slippage. This critical distance is not a predetermined value. The slide means 7 positions the advance means 3 in the new position, the power of the pump being maintained in order to create the vacuum.

In the event that the critical distance is substantially equal to another predetermined distance, the power of the pump is reduced to a predetermined value.

Finally, any of the aforementioned control operations may be implemented in a continuous manner during the packaging operation, with the purpose of obtaining maximum automatic control of the process.

What is claimed is:

1. A method for operating a vertical packaging machine while the packaging machine is producing packages, the method comprising:

forming a laminar film into a laminar tube by use of a forming tool, advancing the laminar tube through the vertical packaging machine by use of at least first and second drive belts arranged facing each other, detecting when a slippage or a risk of slippage of at least one of the first and second drive belts in relation to the laminar tube occurs; and automatically moving the first drive belt towards or away from the forming tube while the laminar tube is being advanced through the vertical packaging machine when slippage or risk of slippage of the first drive belt in relation to the laminar tube is determined, automatically moving the second drive belt towards or away from the forming tube while the laminar tube is being advanced through the vertical packaging machine when slippage or risk of slippage of the second drive belt in relation to the laminar tube is determined, wherein detecting the slippage or risk of slippage between the first drive belt and the laminar tube and detecting the slippage or risk of slippage between the second drive belt and the laminar tube comprises:

measuring an actual advancement of the laminar tube while the packaging machine is producing packages, measuring an advancement of the first drive belt and of the second drive belt while the packaging machine is producing packages, while the packaging machine is producing packages, comparing the actual advancement measurement of the laminar tube with the advancement measurement of each of the first drive belt and of the second drive belt, while the packaging machine is producing packages, determining that there is slippage or a risk of slippage between the first drive belt and the laminar tube if the actual advancement measurement of the laminar tube and the advancement measurement of the first drive belt are different or if the difference between the actual advancement measurement of the laminar tube and the advancement measurement of the first drive belt is greater than a predetermined value, while the packaging machine is producing packages, determining that there is slippage or a risk of slippage between the second drive belt and the laminar tube if the actual advancement measurement of the laminar tube and the advancement measurement of the second drive belt are different or if the difference between the actual advancement measurement of the laminar tube and the advancement measurement of the second drive belt is greater than the predetermined value.

2. A method for operating a vertical packaging machine while the packaging machine is producing packages, the method comprising:

forming a laminar film into a laminar tube by use of a forming tool, advancing the laminar tube through the vertical packaging machine by use of at least first and second drive belts arranged facing each other, detecting when a slippage or a risk of slippage of at least one of the first and second drive belts in relation to the laminar tube occurs; and automatically moving the first drive belt towards or away from the forming tube while the laminar tube is being advanced through the vertical packaging machine when slippage or risk of slippage of the first drive belt in relation to the laminar tube is determined, automatically moving the second drive belt towards or away from the forming tube while the laminar tube is being advanced through the vertical packaging machine when slippage or risk of slippage of the second drive belt in relation to the laminar tube is determined, wherein detecting the slippage or risk of slippage between the first drive belt and the laminar tube and detecting the slippage or risk of slippage between the second drive belt and the laminar tube comprises:

obtaining a first distance measurement between the first drive belt and the forming tool while the packaging machine is producing packages, obtaining a second distance measurement between the second drive belt and the forming tool while the packaging machine is producing packages, comparing the first distance measurement with a predetermined distance value while the packaging machine is producing packages, comparing the second distance measurement with the predetermined distance value while the packaging machine is producing packages, determining while the packaging machine is producing packages that there is slippage or the risk of slippage between the first belt and the laminar tube if the first distance measurement and the predetermined measurement value are different, determining while the packaging machine is producing packages that there is slippage or the risk of slippage between the second belt and the laminar tube if the second distance measurement and the predetermined measurement value are different.

3. A method according to claim 2, further comprising, upon determining that there is slippage or the risk of slippage between the first belt and the laminar tube and while the packaging machine is producing packages, moving the first drive belt towards or away from the forming tool until the predetermined distance is reached, and upon determining that there is slippage or the risk of slippage between the second belt and the laminar tube and while the packaging machine is producing packages, moving the second drive belt towards or away from the forming tool until the predetermined distance is reached.

4. A method for operating a vertical packaging machine comprising:

forming a laminar film into a laminar tube by use of a forming tool, advancing the laminar tube through the vertical packaging machine by use of at least two drive belts arranged facing each other, detecting when a slippage or a risk of slippage of at least one of the drive belts in relation to the laminar tube occurs; and automatically moving the drive belt towards or away from the forming tube while the laminar tube is being advanced through the vertical packaging machine when slippage or risk of slippage of at least one of the drive belt in relation to the laminar tube is determined wherein each drive belt constitutes a part of an advance module, the method further comprising a vacuum operation during which a vacuum is induced between the drive belt and the laminar tube by means of at least one vacuum pump so that the corresponding drive belt holds and drives the laminar tube, slippage of the corresponding drive belt in relation to the laminar tube is detected automatically, the actual advance of the laminar tube and the advance of the drive belt being measured and it being determined that there is slippage if the two values are different or if the difference between the two values is greater than a predetermined value a vacuum level being measured and it being determined that there is a risk of slippage if the vacuum level measured is smaller than a predetermined vacuum level, and the distance between the respective advance module and the forming tool is measured, the distance measured being compared with a predetermined distance, the power with which the vacuum pump creates the vacuum increases in the event that the distance measured is substantially equal to the predetermined distance.

5. A method according to claim 4, wherein once a movement without slippage of the laminar tube in relation to the forming tool has been ensured, after increasing the power of the vacuum pump, the respective advance module is moved away by a distance in relation to the forming tool.

6. A method according to claim 5, wherein if the distance is substantially equal to a predetermined distance, the power of the pump is reduced to a predetermined value.

7. A method according to claim 6, wherein the position of each of the advance modules relative to the forming tool is driven by a displacement module, the method further comprising a start-up operation that includes comparing a measured force the displacement module is exerting on the forming tool through the respective advance module with a predetermined force, with the result that in the event of said measured force being smaller than the predetermined force, the displacement module is operated and moves the respective advance module towards the forming tool until the measured force reaches substantially the value of the predetermined force, and wherein once the force exerted by the displacement module reaches substantially the value of the predetermined force, the displacement module is operated and moves the advance module in an opposite direction, the advance module being moved away by a predetermined distance from the forming tool.

* * * * *